US010578008B2

(12) United States Patent
Gonze et al.

(10) Patent No.: US 10,578,008 B2
(45) Date of Patent: Mar. 3, 2020

(54) COOLANT PUMP FLOW RATIONALIZATION USING COOLANT PUMP PARAMETERS

(71) Applicant: GM GLOBAL TECHNOLOGY OPERATIONS LLC, Detroit, MI (US)

(72) Inventors: Eugene V. Gonze, Pinckney, MI (US); Michael J. Paratore, Jr., Howell, MI (US); Daniel J. Shepard, Ann Arbor, MI (US)

(73) Assignee: GM GLOBAL TECHNOLOGY OPERATIONS LLC, Auburn Hills, MI (US)

( * ) Notice: Subject to any disclaimer, the term of this patent is extended or adjusted under 35 U.S.C. 154(b) by 183 days.

(21) Appl. No.: 15/911,725

(22) Filed: Mar. 5, 2018

(65) Prior Publication Data

US 2019/0271260 A1 Sep. 5, 2019

(51) Int. Cl.
*F01P 11/18* (2006.01)
*F01P 5/14* (2006.01)

(52) U.S. Cl.
CPC ..... *F01P 11/18* (2013.01); *F01P 5/14* (2013.01); *F01P 2025/04* (2013.01); *F01P 2031/20* (2013.01); *F01P 2031/36* (2013.01)

(58) Field of Classification Search
CPC ..... F01P 11/18; F01P 5/14
See application file for complete search history.

(56) References Cited

U.S. PATENT DOCUMENTS 7,465,508 B2 * 12/2008 Alp ..... H01M 8/04029 429/414
2012/0015587 A1 * 1/2012 Leishman ..... B23Q 11/1038 451/7
2012/0204965 A1 * 8/2012 Loldj ..... F17D 3/00 137/14
2017/0350303 A1 * 12/2017 Duan ..... F01P 3/02
2017/0356327 A1 * 12/2017 Gonze ..... F01P 7/16

* cited by examiner

*Primary Examiner* — Jamel E Williams

(57) ABSTRACT

A method for coolant pump flow rationalization using coolant pump parameters includes calculating a first pump coolant flow based on a coolant input pressure sensor signal and the coolant pump speed. Further, the method includes calculating a second pump coolant flow based on coolant pump current and coolant pump speed when the first pump coolant flow is greater than a predetermined threshold; and comparing the first pump coolant flow with the second pump coolant flow to rationalize the coolant pressure sensor signal.

9 Claims, 5 Drawing Sheets

COOLANT PUMP FLOW RATIONALIZATION USING COOLANT PUMP PARAMETERS

FIELD

The present disclosure relates to internal combustion engines, and more specifically, to a method for coolant pump flow rationalization using coolant pump parameters.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust air and fuel within cylinders to generate drive torque. Combustion of air and fuel also generates heat and exhaust. Exhaust produced by an engine flows through an exhaust system before being expelled to atmosphere.

Engine cooling systems typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

A method for coolant pump flow rationalization using coolant pump parameters according to an exemplary embodiment includes calculating a first pump coolant flow based on a coolant input pressure sensor signal and the coolant pump speed. Another aspect of the exemplary embodiment includes calculating a second pump coolant flow based on coolant pump current and coolant pump speed when the first pump coolant flow is greater than a predetermined threshold. And still another aspect includes comparing the first pump coolant flow with the second pump coolant flow to rationalize the coolant input pressure sensor signal.

A further aspect in accordance with the exemplary embodiment includes detecting a coolant input pressure sensor failure when a difference between the first pump coolant flow and the second pump coolant flow is greater than a predetermined coolant flow error threshold. And yet another aspect includes setting a diagnostic fault code when the difference between the first pump coolant flow and the second pump coolant flow is greater than a predetermined coolant flow error threshold. Yet one other aspect includes activating an alarm when the difference between the first pump coolant flow and the second pump coolant flow is greater than a predetermined coolant flow error threshold.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Engine cooling systems typically include a coolant pump and a coolant valve. The coolant pump circulates coolant through a cooling system for an engine. The coolant valve directs the coolant to different components of the cooling system and may be used to regulate coolant flow.

Engine control systems typically control the coolant pump and the coolant valve based on a function or mapping that relate a desired rate of coolant flow through the cooling system to a coolant pump speed and a coolant valve position. The desired coolant flow rate is adjusted to minimize a difference between a measured coolant temperature and a target coolant temperature.

Aging and vehicle to vehicle architecture variations of the cooling system plumbing creates variation in the backpressure within the cooling system. If this backpressure variation is not captured in the function or mapping that relates the desired coolant flow rate, the engine may overheat due to insufficient coolant flow. Adding a pressure sensor in the cooling system allows for these backpressure variations to be readily determined. However, readings from the pressure sensor need to be rationalized to ensure that reliable information is being used for determining the function or mapping related to the desired coolant flow.

In accordance with aspects of an exemplary embodiment, a method for rationalizing coolant pump flow using coolant pump operating parameters is provided. By using the coolant pump current and speed, coolant flow rate through the coolant pump can be determined. Using this coolant flow rate, the pressure sensor can be rationalized by comparing the coolant flow rate calculated from the pressure sensor and pump speed against the flow rate calculated from the pump current and speed.

Figure 1:
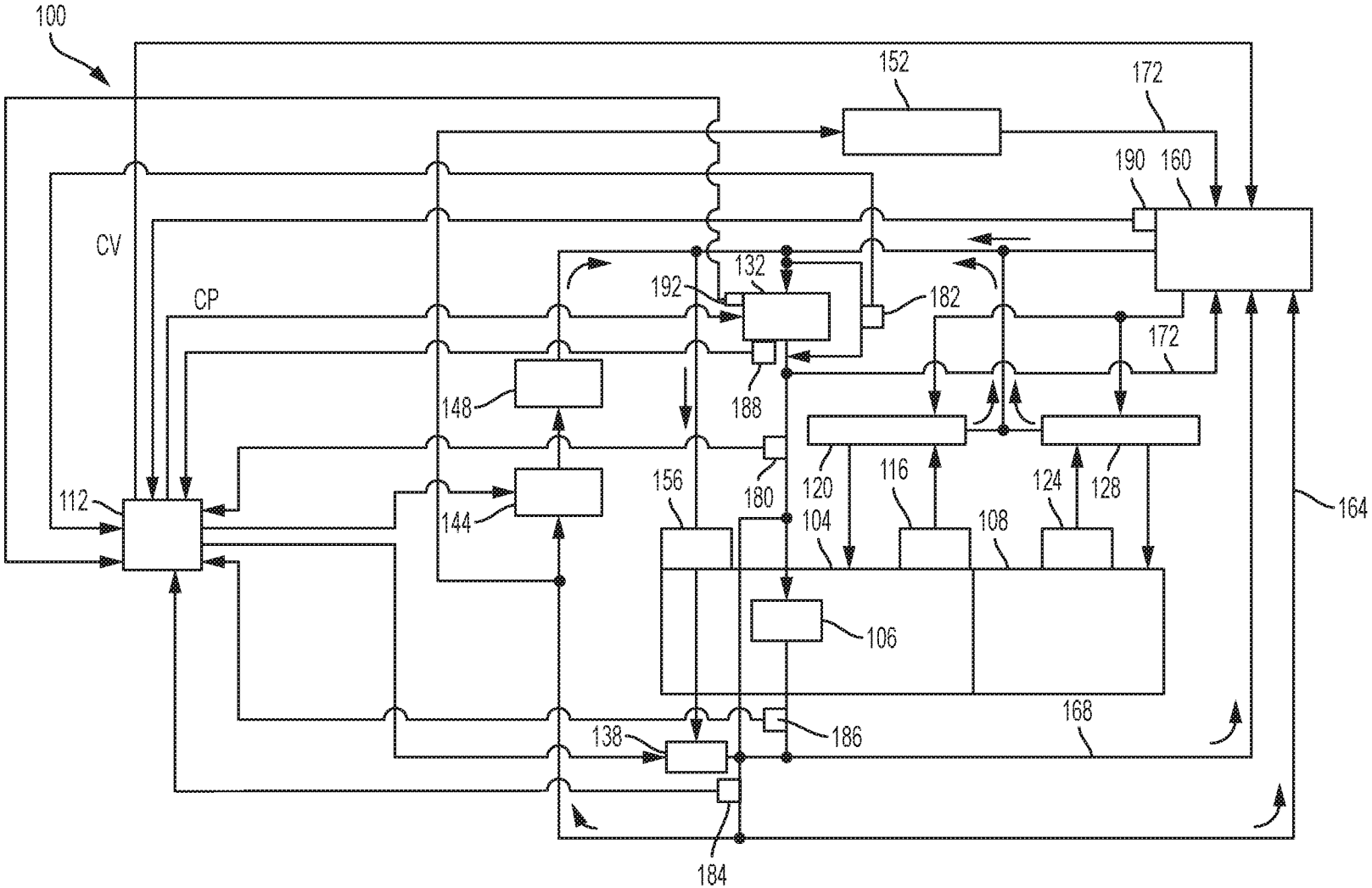
FIG. 1 is a functional block diagram of an example vehicle system according to the principles of the present disclosure.

Referring now to FIG. 1, an example vehicle system 100 includes an engine 104. The engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. When the engine oil is warm, the first heat exchanger 120 may transfer heat from the engine oil to coolant flowing through the first heat exchanger 120 and/or to air passing the first heat exchanger 120.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. When the transmission fluid is cold, the second heat exchanger 128 may transfer heat from the transmission fluid to coolant flowing through the second heat exchanger 128 and/or to air passing the second heat exchanger 128.

The engine 104 includes a plurality of channels through which engine coolant ("coolant") can flow. For example, the engine 104 may include one or more channels through the head portion of the engine 104, one or more channels through a block portion of the engine 104, and/or one or more channels through the IEM 106. The engine 104 may also include one or more other suitable coolant channels.

When a coolant pump 132 is on, the coolant pump 132 pumps coolant to various channels. While the coolant pump 132 is shown and will be discussed as an electric coolant pump, the coolant pump 132 may alternatively be mechanically driven (e.g., by the engine 104) or another suitable type of variable output coolant pump.

A block valve (BV) 138 may regulate coolant flow out of (and therefore through) the block portion of the engine 104. A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle.

Coolant output from the engine 104 also flows to a fourth heat exchanger 152. The fourth heat exchanger 152 may be referred to as a radiator. The fourth heat exchanger 152 transfers heat to air passing the fourth heat exchanger 152. A cooling fan (not shown) may be implemented to increase airflow passing the fourth heat exchanger 152.

Various types of engines may include one or more turbochargers, such as turbocharger 156. Coolant may be circulated through a portion of the turbocharger 156, for example, to cool the turbocharger 156.

A coolant valve 160 may include a multiple input, multiple output valve or one or more other suitable valves. The ECM 112 controls actuation of the coolant valve 160. The components of the vehicle system 100 through which coolant flows may collectively be referred to as a cooling system. Thus, the first heat exchanger 120, the second heat exchanger 128, the coolant pump 132, the block valve 138, the heater valve 144, the third heat exchanger 148, the coolant valve 160, and the coolant lines that extend between these components may collectively be referred to as the cooling system.

Figure 2A:
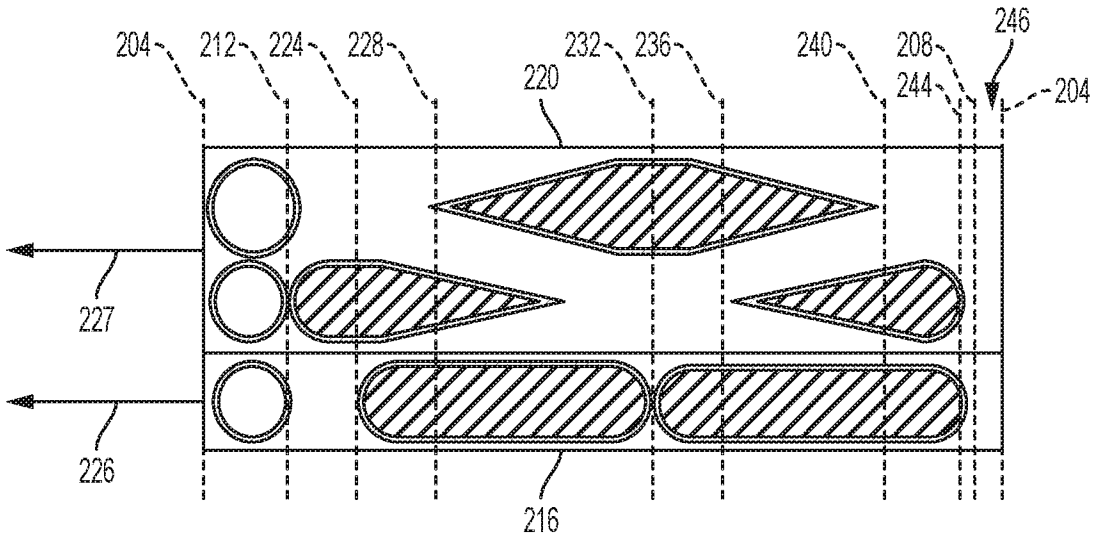
FIG. 2A is an example diagram illustrating coolant flow to and from a coolant valve at various positions of the coolant valve.

In various implementations, the coolant valve 160 may be partitioned and have two or more separate valve chambers. FIG. 2A illustrates coolant flow to and from an example of the coolant valve 160 where the coolant valve 160 includes two valve chambers. Although FIG. 2A depicts the coolant valve 160 as including two valve chambers, the coolant valve 160 may include more than two valve chambers.

Referring now to FIGS. 1 and 2A, the coolant valve 160 can be rotated between two end positions 204 and 208. Although the coolant valve 160 may be spherical or cylindrical, FIG. 2A depicts the coolant valve 160 as flat for illustration purposes only. Since the coolant valve 160 is illustrated in this manner, the end position 204 appears twice in FIG. 2A even though the end position 204 is actually a single rotational position of the coolant valve 160. The end position 204 shown on the left side of FIG. 2A corresponds to a valve position of 0 degrees. The end position 204 shown on the right side of FIG. 2A corresponds to a valve position of 360 degrees.

When the coolant valve 160 is positioned between the end position 204 and a first position 212, coolant flow into a first chamber 216 is blocked, and coolant flow into a second chamber 220 is blocked. The coolant valve 160 outputs coolant from the first chamber 216 to the first heat exchanger 120 and the second heat exchanger 128 as indicated by 226. The coolant valve 160 outputs coolant from the second chamber 220 to the coolant pump 132 as indicated by 227.

When the coolant valve 160 is positioned between the first position 212 and a second position 224, coolant flow into the first chamber 216 is blocked and coolant output by the engine 104 flows into the second chamber 220 via a first coolant path 164. Coolant flow into the second chamber 220 from the fourth heat exchanger 152, however, is blocked. The ECM 112 may actuate the coolant valve 160 to between the first and second positions 212 and 224, for example, to warm the engine oil.

When the coolant valve 160 is positioned between the second position 224 and a third position 228, coolant output by the IEM 106 via a second coolant path 168 flows into the first chamber 216, coolant output by the engine 104 flows into the second chamber 220 via the first coolant path 164, and coolant flow into the second chamber 220 from the fourth heat exchanger 152 is blocked. The ECM 112 may actuate the coolant valve 160 to between the second and third positions 224 and 228, for example, to warm the engine oil and the transmission fluid.

When the coolant valve 160 is positioned between the third position 228 and a fourth position 232, coolant output by the IEM 106 via the second coolant path 168 flows into the first chamber 216, coolant output by the engine 104 flows into the second chamber 220 via the first coolant path 164, and coolant output by the fourth heat exchanger 152 flows into the second chamber 220. Coolant flow into the first chamber 216 from the coolant pump 132 via a third coolant path 172 is blocked when the coolant valve 160 is between the end position 204 and the fourth position 232. The ECM 112 may actuate the coolant valve 160 to between the third and fourth positions 228 and 232, for example, to warm the engine oil and the transmission fluid.

When the coolant valve 160 is positioned between the fourth position 232 and a fifth position 236, coolant output by the coolant pump 132 flows into the first chamber 216 via the third coolant path 172, coolant flow into the second chamber 220 via the first coolant path 164 is blocked, and coolant output by the fourth heat exchanger 152 flows into the second chamber 220. When the coolant valve 160 is positioned between the fifth position 236 and a sixth position 240, coolant output by the coolant pump 132 flows into the first chamber 216 via the third coolant path 172, coolant output by the engine 104 flows into the second chamber 220 via the first coolant path 164, and coolant output by the fourth heat exchanger 152 flows into the second chamber 220.

When the coolant valve 160 is positioned between the sixth position 240 and a seventh position 244, coolant output by the coolant pump 132 flows into the first chamber 216 via the third coolant path 172, coolant output by the engine 104 flows into the second chamber 220 via the first coolant path 164, and coolant flow from the fourth heat exchanger 152 into the second chamber 220 is blocked.

Coolant flow into the first chamber 216 from the IEM 106 via the second coolant path 168 is blocked when the coolant valve 160 is between the fourth position 232 and the seventh position 244. The ECM 112 may actuate the coolant valve 160 to between the fourth and seventh positions 232 and 244, for example, to cool the engine oil and the transmission fluid. Coolant flow into the first and second chambers 216 and 220 is blocked when the coolant valve 160 is positioned between the seventh position 244 and the end position 208. The ECM 112 may attempt to actuate the coolant valve 160 to a position within a predetermined range 246 defined between the end position 208 and the end position 204, for example, for performance of one or more diagnostics.

Referring back to FIG. 1, a coolant input temperature (CIT) sensor 180 measures a temperature of coolant input to (or on an inlet side of) the engine 104. A coolant input pressure (CIP) sensor 182 measures a pressure of coolant input to (or on an inlet side of) the engine 104. The coolant pump 132 may be disposed in a first coolant line, the coolant input pressure sensor 182 may be disposed in a second coolant line, and coolant may flow through the first and second coolant lines in parallel as shown.

A coolant output temperature (COT) sensor 184 measures a temperature of coolant output from (or on an outlet side of) the engine 104. An IEM coolant temperature sensor (ECT) 186 measures a temperature of coolant output from the IEM 106. A coolant pump speed (CPS) sensor 188 measures a speed of the coolant pump 132. A coolant valve position (CVP) sensor 190 measures a position of the coolant valve 160. A pump current (PCS) sensor 192 measures the electric current being used by the coolant pump 132. The pump current sensor 192 output is sent to the ECM 112 for calculating pump flow rate in accordance with aspects of the exemplary embodiment.

Output of the coolant pump 132 varies as the pressure of coolant input to the coolant pump 132 varies. For example, at a given speed of the coolant pump 132, the output of the coolant pump 132 increases as the pressure of coolant input to the coolant pump 132 increases, and vice versa. The position of the coolant valve 160 varies the pressure of coolant input to the coolant pump 132. The ECM 112 may control the speed of the coolant pump 132 based on the position of the coolant valve 160 to more accurately control the output of the coolant pump 132.

Figure 3:
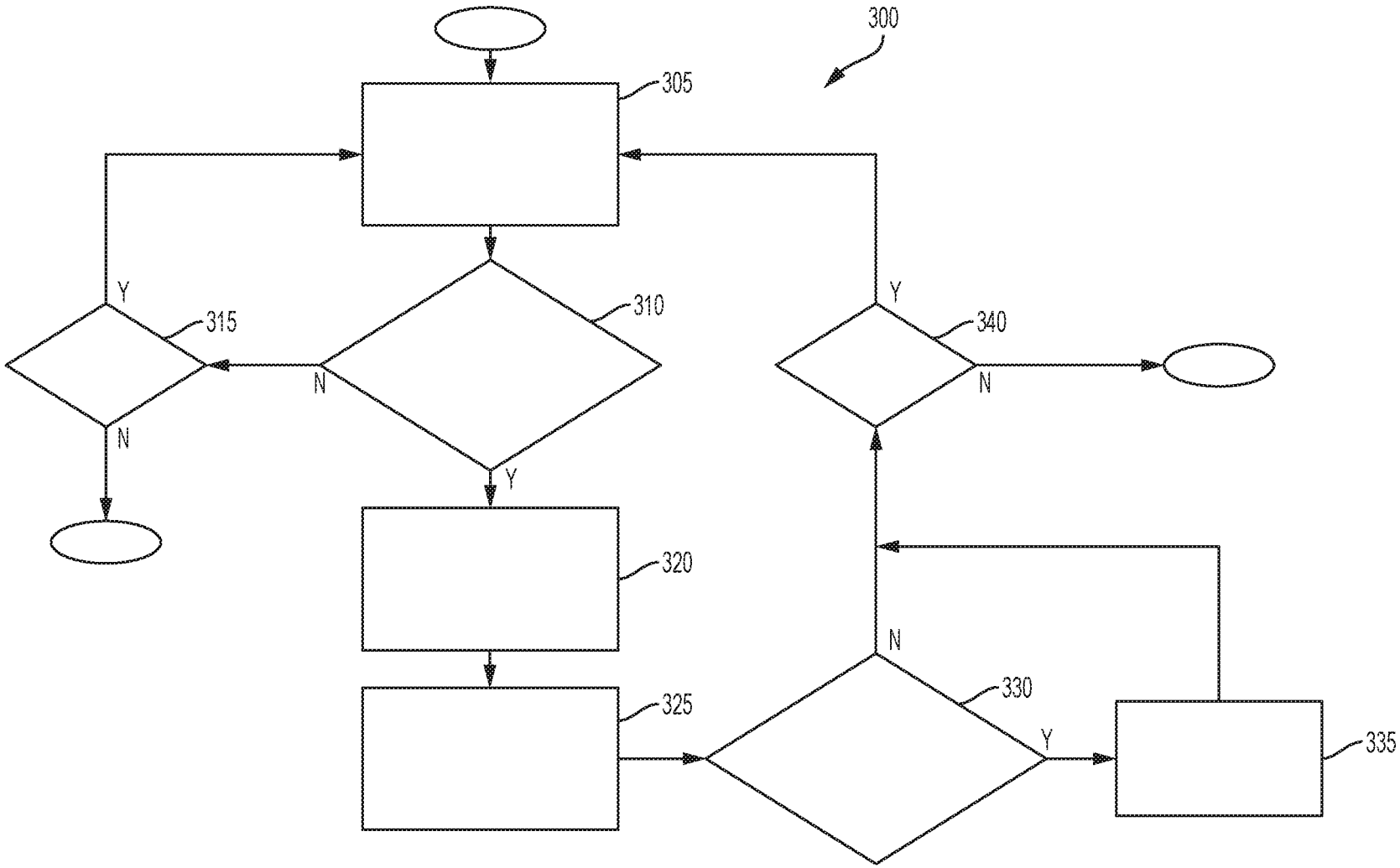
FIG. 3 is a flowchart illustrating a method for coolant pump flow rationalization using coolant pump parameters in accordance with an exemplary embodiment.

Referring now to FIG. 3, an example of a method 300 for coolant pump flow rationalization using coolant pump parameters in accordance with aspects of an exemplary embodiment.

Figure 2B:
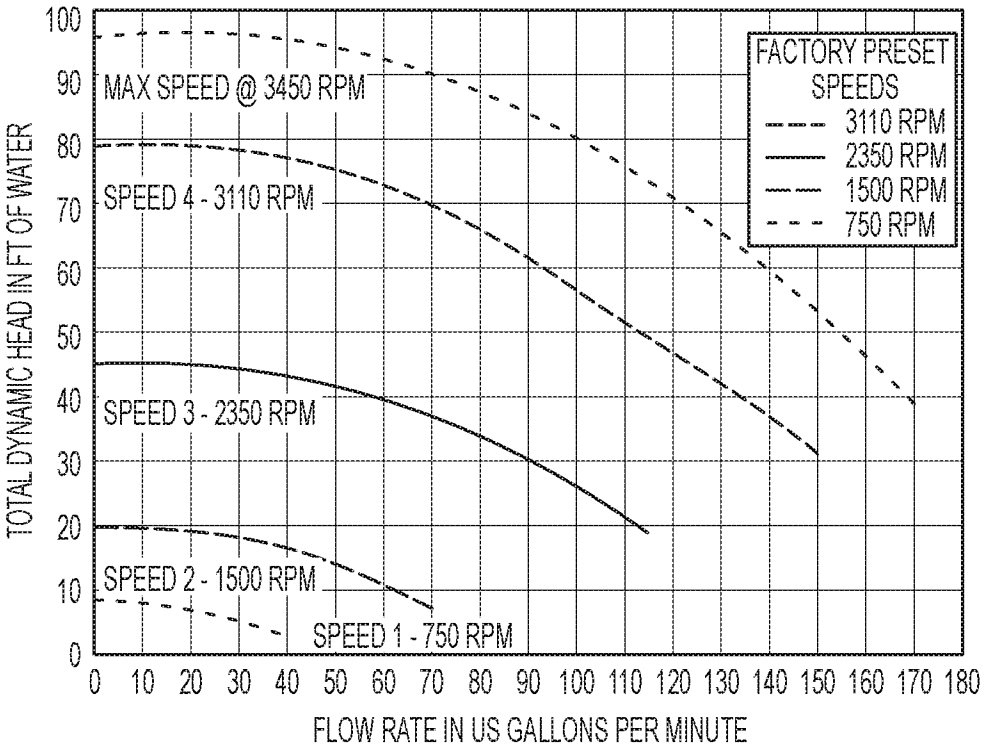
FIG. 2B is an illustration of coolant pump performance curves of flow rates for various coolant pump speeds (RPM) and pressure characteristics.

At block 305, the method begins with calculating a first pump flow based on the pressure of coolant input to the engine as measured by the coolant inlet pressure sensor 182 and the coolant pump speed as measured by the coolant pump speed sensor 188. With reference to FIG. 2B, it is illustrated that at a constant pump speed (RPM) the coolant flow rate increases as the coolant pressure decreases.

Next, at block 310, the method continues with determining if the first pump flow is greater than a predetermined pump flow threshold. If the first pump flow is not greater than the predetermined pump flow threshold then, at block 315, the method determines if the engine is still on. If the engine is off then the method ends. If the engine is still on then the method returns to block 305.

Figure 2C:
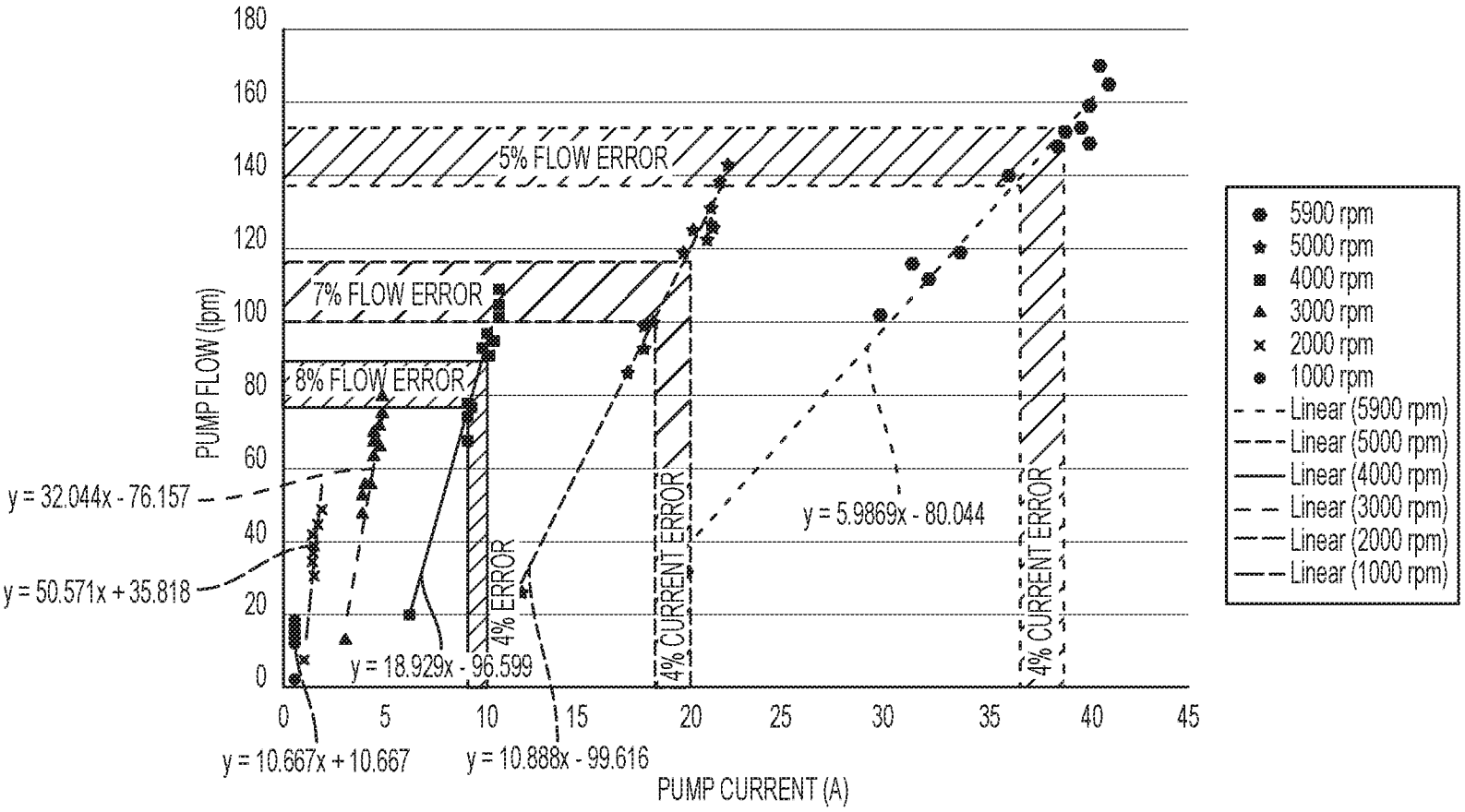
FIG. 2C is an illustration of coolant pump performance data of flow rates for various coolant pump speeds (RPM) and coolant pump current.

If the first pump flow is determined to be greater than the predetermined pump flow threshold, then at block 320, the method continues with calculating a second pump flow based on a coolant pump current as measured by the pump current sensor 192 and the coolant pump speed as measured by the coolant pump speed sensor 188. Referring to FIG. 2C, it is illustrated that the coolant flow rate is a function of the coolant pump speed (RPM) and the electrical current drawn by the coolant pump. More particularly, FIG. 2C illustrates that at a constant pump speed (RPM) the coolant flow rate increases as the electrical current drawn by the coolant pump increases.

Next, at block 325, the method continues with comparing the first pump flow to the second pump flow to determine a flow error value. The absolute value of the difference will give the flow error value.

At block 330, a determination is made whether the flow error value is greater than a predetermined flow error threshold. If the flow error is determined to be greater than the predetermined flow error threshold then, at block 335, a fault is set in the ECM 112 and a service lamp/alarm will be activated. Next, the method moves to block 340 to determine if the engine is still on. If so, then the method returns to block 305 for repeating the rationality check. If the engine is off then the method ends until the next engine on condition.

Referring again to block 330, if the flow error is determined to be less than the predetermined flow error threshold then the method continues at block 340 to determine if the engine is still on. If so, then the method returns to block 305 for repeating the rationality check. If the engine is off then the method ends until the next engine on condition.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A method for coolant pump flow rationalization using coolant pump parameters comprising:

calculating a first pump coolant flow based on a coolant input pressure sensor signal and the coolant pump speed;

calculating a second pump coolant flow based on coolant pump current and coolant pump speed when the first pump coolant flow is greater than a predetermined threshold; and comparing the first pump coolant flow with the second pump coolant flow to rationalize the coolant input pressure sensor signal.

2. The method of claim 1 further comprising detecting a coolant input pressure sensor failure when a difference between the first pump coolant flow and the second pump coolant flow is greater than a predetermined coolant flow error threshold.

3. The method of claim 2 further comprising setting a diagnostic fault code when the difference between the first pump coolant flow and the second pump coolant flow is greater than a predetermined coolant flow error threshold.

4. The method of claim 2 further comprising activating an alarm when the difference between the first pump coolant flow and the second pump coolant flow is greater than a predetermined coolant flow error threshold.

5. A method for coolant pump flow rationalization using coolant pump parameters comprising:

calculating a first pump coolant flow based on a coolant input pressure sensor signal and the coolant pump speed;

calculating a second pump coolant flow based on coolant pump current and coolant pump speed when the first pump coolant flow is greater than a predetermined threshold;

comparing the first pump coolant flow with the second pump coolant flow to rationalize the coolant pressure sensor signal; and detecting a coolant input pressure sensor failure when a difference between the first pump coolant flow and the second pump coolant flow is greater than a predetermined coolant flow error threshold.

6. The method of claim 5 further comprising setting a diagnostic fault code when the difference between the first pump coolant flow and the second pump coolant flow is greater than a predetermined coolant flow error threshold.

7. The method of claim 5 further comprising activating an alarm when the difference between the first pump coolant flow and the second pump coolant flow is greater than a predetermined coolant flow error threshold.

8. A method for coolant pump flow rationalization using coolant pump parameters comprising:

calculating a first pump coolant flow based on a coolant input pressure sensor signal and the coolant pump speed;

calculating a second pump coolant flow based on coolant pump current and coolant pump speed when the first pump coolant flow is greater than a predetermined threshold;

comparing the first pump coolant flow with the second pump coolant flow to rationalize the coolant pressure sensor signal;

detecting a coolant input pressure sensor failure when a difference between the first pump coolant flow and the second pump coolant flow is greater than a predetermined coolant flow error threshold; and setting a diagnostic fault code when the difference between the first pump coolant flow and the second pump coolant flow is greater than a predetermined coolant flow error threshold.

9. The method of claim 8 further comprising activating an alarm when the difference between the first pump coolant flow and the second pump coolant flow is greater than a predetermined coolant flow error threshold.

* * * * *